US006207286B1

(12) United States Patent
Anglin et al.

(10) Patent No.: US 6,207,286 B1
(45) Date of Patent: Mar. 27, 2001

(54) LUBRICATED SHEET PRODUCT AND LUBRICANT COMPOSITION

(75) Inventors: James R. Anglin, Export; Donald R. Smith, Gibsonia, both of PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/271,423

(22) Filed: Mar. 17, 1999

Related U.S. Application Data

(63) Continuation-in-part of application No. 08/844,683, filed on Apr. 18, 1997, now abandoned.

(51) Int. Cl.[7] ..... B32B 15/08
(52) U.S. Cl. ..... 428/461; 428/462; 428/458
(58) Field of Search ..... 428/461, 462, 428/458

(56) References Cited

U.S. PATENT DOCUMENTS

| | | | |
|---|---|---|---|
| 2,151,353 | 3/1939 | Montgomery | 205/21 |
| 2,431,008 | 11/1947 | Wright | 252/59 |
| 3,923,671 | 12/1975 | Knepp | 252/49.5 |
| 4,012,270 | 3/1977 | Fitko | 156/306 |
| 4,292,187 | 9/1981 | Hentschel et al. | 252/49.5 |
| 4,452,711 | 6/1984 | Laemmle | 252/49.3 |
| 4,452,712 | 6/1984 | Laemmle | 252/49.3 |
| 4,749,502 | 6/1988 | Alexander et al. | 252/35 |
| 4,828,727 | 5/1989 | McAninch | 252/11 |
| 4,891,161 | 1/1990 | Tanikawa et al. | 252/56 S |
| 5,020,350 | 6/1991 | Knepp et al. | 72/45 |
| 5,069,806 | 12/1991 | Trivett | 252/52 A |
| 5,151,205 | 9/1992 | Culpon, Jr. | 252/56 R |
| 5,194,168 | 3/1993 | Aoki et al. | 252/50 |
| 5,436,379 | 7/1995 | Heilman et al. | 585/10 |
| 5,759,965 | 6/1998 | Sumiejski | 508/186 |
| 5,761,941 | 6/1998 | Matsui et al. | 72/42 |

*Primary Examiner*—Duc Truong
(74) *Attorney, Agent, or Firm*—Gary P. Topolosky

(57) ABSTRACT

There is disclosed a metal sheet product, more particularly formed food container stock and/or industrial sheet product, which has been treated with an ester-free, lubricant composition that is suitable for direct food contact. This composition consists essentially of: (i) about 10–90 wt. % of a polyalphaolefin; (ii) about 10–90 wt. % of an oleic acid; (iii) about 0–60 wt. % of an isostearic acid; and preferably, about 10–35 wt. % isostearic acid. It should be noted that especially good smudge testing results were observed with the presence of oleic acid. In alternative embodiments, the lubricant composition further includes: (iv) up to about 5 wt. % of an antioxidant, preferably about 0.1–3 wt. % butylated hydroxytoluene; and (v) up to about 10 wt. % of a conductivity enhancer, such as about 2–7 wt. % lecithin. When applied in total deposited weights of about 0.1–30 mg/ft$^2$ per side, this invention produces formed food container stock or industrial sheet having improved formability and relatively lower smudge results when compared to its fatty acid and ester-containing alternatives.

60 Claims, No Drawings

LUBRICATED SHEET PRODUCT AND LUBRICANT COMPOSITION

CROSS REFERENCE TO RELATED APPLICATIONS

This application is a continuation-in-part of application Ser. No. 08/844,683, filed on Apr. 18, 1997, now abandoned, the disclosure of which is fully incorporated by reference herein.

BACKGROUND OF THE INVENTION

1. Field of the Invention

This invention relates to the lubrication of metal sheet product, either bare or coated on one or both sides. Such sheet product, including foil gauge thicknesses thereof, is suitable for use in making formed food containers and trays, and for making industrial sheet products therefrom, including but not limited to fin stock, non-food lidding and numerous air handling equipment applications like spiral duct products. The invention further relates to aluminum sheet stock sold in an already lubricated state, ready for further processing. Industrial sheet product forms are also disclosed. Preferably this invention relates to making food- and/or beverage-contacting sheet product from such aluminum alloys as 1050, 1100, 1145, 3003, 3004, 5017, 5042, 5052, 5082, 5182, 5352, 8011 and 8111 aluminum (Aluminum Association designations), said products being made and sold in numerous tempers including but not limited to: 0, H19, and H24. An improved lubricant composition for such food and non-food sheet applications is also described.

2. Technology Review

The aluminum industry supplies food container and tray manufacturers with millions of pounds of flat or coiled sheet product each year. These manufacturers convert such sheet product into food-contacting containers in numerous shapes and sizes. Such sheet products are often coated with a lubricant composition on one or both surfaces by the sheet supplier, with additional lubricant being applied as required by the container and/or tray maker prior to fabrication. The beer and beverage industry also uses substantial quantities of lubricated aluminum product each year in their manufacture of container or can bodies and lidding. Any lubricant residue on food or beverage packaging must meet all applicable U.S. Food and Drug Administration (or "FDA") requirements. For numerous industrial, non-food contacting applications, FDA regulations are not an issue, however.

Liquid and solid lubricants are used in metal working operations to reduce and control friction and wear between the surface of metal being worked and surfaces of the apparatus carrying out a given metal working operation. Lubricants reduce and control friction and wear by maintaining a thin film of an appropriate composition between the contacting surfaces in relative motion. Lubricants can also improve tooling cleanliness and lifetime and provide good surface quality on the worked product.

In addition to their friction and wear reducing characteristics, lubricant compositions are expected to fulfill certain other requirements in sheet forming applications. They should: be easy to apply and remove where removal is warranted; afford some protection to the metal surface during handling and storage; present no health hazards to persons coming in contact with the composition; and cause no degradation of the surfaces in contact therewith. For food-contacting packages, lubricant residues should not affect characteristics, such as appearance, odor or taste, of the products packaged therein. They may help facilitate the initial packaging of foodstuffs in these containers, e.g., by aiding in the spreading of pie dough onto properly lubricated pie pans or "tins". In other instances, lubricants help facilitate separation of the food from the formed sheet containers or trays in which such foods are warmed, cooked or baked.

It is known to apply lubricant compositions to aluminum sheet products through numerous methods. One representative means employs an electrostatic spray coater or atomizer as set forth in commonly-assigned Grassel U.S. Pat. No. 4,839,202, the disclosure of which is fully incorporated by reference herein. Still other known lubricant application means include dipping the sheet product and/or passing it through any of various applicators which generate fine droplets of lubricant for deposit on said sheet product with electrostatic assistance, or between one or more rotating roll pairs designed to transfer lubricant to the sheet from the roll. The lubricant composition/blend of this invention can be applied by any of the foregoing means. On a less preferred basis, the lubricant composition of this invention may be added to one or more solvents prior to application of the solvent to the sheet metal, said solvent(s) being suitable for evaporation and recovery for reuse. Representative solvents include hexane and other common solvents, as well as many known water dispersed solvent compositions. For some sheet products, lubricated materials are further subjected to purposeful processing steps to impart mostly stylistic, but sometimes functional, improvements to surfaces which the consumer/end user most often sees or comes in contact with.

SUMMARY OF THE INVENTION

It is a principal objective of this invention to provide a lubricant composition that: (i) is in a liquid state at about room temperature; (ii) is suitable for direct food contact (or is compliant with current U.S. Food and Drug Administration ("FDA") regulations); (iii) enables very good metal forming performance; and (iv) is less prone to loosen smudge than comparable lubricants containing fatty acids and esters as determined in a commonly used wiping test following application of the lubricant composition to a metal surface. It is another principal objective to control the oxidative stability of the lubricant composition over time, thereby reducing aging effects such as odor generation. It is a further, objective of this invention to provide such a lubricant composition in an "easy to apply" form, i.e., it can be applied electrostatically, as a neat liquid or dissolved in a solvent. In such a state, there would be no need for heating to liquefy and no issues with waxy products having a tacky or brittle consistency that can lead to lubricant transfer (or "pickoff") between rolls and sheet or between adjacent sheet wraps thereby resulting in an uneven lubricant coverage. With this invention, there is minimal texture (or lubricant) buildup on the equipment used to roll or form metal products so lubricated.

It is another principal objective to provide a lubricant composition for formed food container stock which combines the strong forming performance of both isostearic and oleic acids. The main components of this lubricant composition are all liquids, thereby enhancing the flexibility of formulation for different application methods. A lubricant based on a high quality oleic acid provides minimal odor and a limited tendency to undergo undesired oxidation relative to many fatty chemicals. Though other fatty acid choices may have better oxidative stability, including isostearic acid, degradation can be further minimized through the addition of an antioxidant, such as butylated hydroxytoluene to the composition. The optional introduction of a conductivity-enhancing additive can provide adequate electrical conductivity for applying this lubricant electrostatically to metal being handled at production line speeds of up to 5,000 ft/min. Additions of up to about 10 wt. % lecithin and/or other ionic materials like fatty acid salts enable the electrostatic applications of this invention.

In accordance with the foregoing objectives and advantages, there is provided a metal sheet product, more particularly formed food container stock and/or industrial sheet product, which has been treated with a lubricant composition consisting essentially of (i) about 10–90 wt. % of a polyalphaolefin; (ii) about 10–90 wt. % of an oleic acid; (iii) about 0–60 wt. % of an isostearic acid; and preferably, about 10–35 wt. % isostearic acid. In alternative embodiments, the lubricant composition further includes: (iv) up to about 5 wt. % of an antioxidant, preferably about 0.1–3 wt. % butylated hydroxytoluene; and (v) up to about 10 wt. % of a conductivity enhancer, such as about 2–7 wt. % lecithin. With the application of said composition onto sheet at total deposited weights of about 0.1–30 mg/ft$^2$ per side, this invention results in food- and non-food contacting products having improved formability, oxidative stability, and smudge performance. For industrial uses, the lube of this invention may be applied at more than 30 mg/ft$^2$/side.

DETAILED DESCRIPTION OF PREFERRED EMBODIMENTS

In the following detailed description, repeated reference is made to the application of preferred lubricant compositions to 1000, 3000, 5000 and 8000 Series aluminum sheet products (Aluminum Association designations). It is to be understood, however, that this same composition and resultant sheet product may have other applications to steel and other formed food container and tray products. When referring to relative component percentages, all references are to percent by weight, or abbreviated "wt. %", unless otherwise expressly indicated.

When referring to "sheet" products herein, such designations are meant to encompass all sheet and foil product thicknesses or gauges, including those higher than 0.006 inch (typically "sheet") and those 0.006 inch or less (typically "foil"). The lubricant composition of this invention may be applied to one or both sides, coated or bare, of a substantially planar product ranging in overall thickness from about 0.00025–0.0200 inch thick. When referring to "food" products, said term is meant to include both liquid and solid foodstuffs. When referring to "containers" in the claims, and elsewhere throughout the description of this invention, said term is meant to include containers, trays and the lidding or lidstock for each.

When referring to any numerical value, or range of values throughout this description and accompanying claims, it is to be understood that each range expressly includes every full and fractional number between the stated range maximum and minimum, such that a composition that includes about 15–65 wt. % of a polyalphaolefin would cover any lubricant having 16, 17, 18 or 20 wt. % of that additive, as well as 64.5, 64.7 and 64.9 wt. %, up to and including 64.999 wt. % polyalphaolefin. The same applies to all other numerical compositional and performance ranges set forth herein.

A first principal component of this invention comprises a polyalphaolefin (or "PAO"), which is a highly refined, synthetic base oil. One suitable version of such material is sold by Amoco Chemicals as Durasyne® 170. Polyalphaolefins are available in various viscosity levels. For instance, Durasyne® 170 has a nominal viscosity of 10 centistokes (or "cSf") as measured at 100° C., though other Durasy° variants have viscosities from as low as about 2 cSt to as high as about 100 cSt or more. Such ranges of viscosities make it possible for customizing lubricant film thicknesses, optimizing sheet forming performance and/or minimizing lubricant migration (or flow after initial application). It is to be understood that other commercially available PAOs may also be used in combination with the other lubricant constituents of this invention. Suitable substitutes for Amoco's Durasyn® include the NEXBASE 2000 Series as manufactured by Neste Alpha OY, Mobil Chemical Company's Mobil SHF product line of PAOs, Uniroyal Chemical's line of Synton® products and Chevron Chemical Company's Oronite Synfluid* line of polyalphaolefins. It is to be understood that other desired viscosities may also be affected by blending together two or more of the aforementioned polyalphaolefins.

Many of the aforementioned polyalphaolefins are derived from decene-1 oligomers. Other suitable products can be manufactured from dodecene-1 or other alpha olefin precursors. On a less preferred basis, certain white mineral oils, or technical white mineral oils consisting of refined mineral oils or synthetic hydrocarbons as described in 21 C.F.R. § 178.3620, the disclosure of which is fully incorporated by reference herein, may be used as a polyalphaolefin supplement and/or substitute in the composition of this invention.

The second principal component hereof is oleic acid. One suitable high purity version of such material is sold by Hercules, Inc. as Pamolyn® 100 FGK. It is a food grade oleic acid, kosher approved, and low in polyunsaturated and saturated acids. This product has a typical oleic acid content on the order of 92 wt. %. Other commercially available oleic acid products may be used in combination with or as a substitute for the aforementioned, however. Most notable among them are Hercules' Pamolyn® 100 Fatty Acid and/or their Pamolyn® 125 commercial grades of oleic acid-based products.

The third principal lubricant component hereof is isostearic acid. One suitable version of such material is sold by Henkel Corporation as Emersol® 874. Said material has a low odor and low level of unsaturation as indicated by its iodine value. Another Henkel material suitable for use herein is Emersol® 871. Union Camp Corporation markets a high purity, vegetable-based oleic acid under the name "Unimate 2000". Their Century 1105 product should also work well in this composition. Finally, it is believed that Unichema's Prisorine® 3501 or Prisorine® 3505 might also work well in the lubricant composition of this invention.

When improved application of this lubricant composition is desired, it is preferred that up to about 10 wt. %, and preferably about 2–7 wt. %, of a conductivity enhancer be added to the foregoing components. One representative, commercially available, lecithin product is sold by ADM Ross & Rowe Lecithins under the name "Thermolec 57". A substitute therefor is sold by Central Soya Company, Inc. as Centrophase® 152. Still another possible supplier of lecithin products is Reichhold Chemicals, Inc., who market their line of Kelecin® products.

For improved oxidation resistance and odor control, it has been observed that up to about 5 wt. % of an antioxidant should be included in the aforementioned formula. One suitable example of such, butylated hydroxytoluene ("BHT"), or di-t-butyl-p-cresol, is sold by many suppliers including Rhein Chemie and PMC Specialties.

Table A that follows summarizes preferred compositions for eight different applications of lubricants in accordance with this invention. Compositions 1–4 emphasize good forming with moderate smudge control, whereas compositions 5–8 emphasize good smudge control with an expected loss of some forming performance. Within each group of compositions, lecithin and/or BHT are added to improve application and/or oxidative stability.

TABLE A

Eight Preferred Lubricant Compositions per this Invention

| Properties/ Component by wt. % | Poly-alphaolefin | Oleic Acid | Isostearic Acid | Lecithin | BHT |
|---|---|---|---|---|---|
| 1. Good forming | 40 | 35 | 25 | — | — |
| 2. Good forming & improved application | 30–38 | 35 | 25 | 2–10 | — |
| 3. Good forming & oxidative stability | 35–40 | 35 | 25 | — | 0.02–5 |
| 4. 1 & 2 & 3 combined | 25–38 | 35 | 25 | 2–10 | 0.02–5 |
| 5. Good smudge control | 65 | 35 | — | — | — |
| 6. Good smudge control & improved application | 55–63 | 35 | — | 2–10 | — |
| 7. Good smudge control & oxidative stability | 60–65 | 35 | — | — | 0.02–5 |
| 8. 5 & 6 & 7 combined | 50–63 | 35 | — | 2–10 | 0.02–5 |

Experimental Results

The evolution of this invention resulted from an analysis of numerous lubricant comparative test results. From the following Table 1 data, a forced ranking of test results for: (1) smudge; and (2) Moving Film Stationary Sled (or "MOFISS"), used to determine relative surface friction and wear resistance, revealed that smudge readings worsened with the presence of fatty acids but that MOFISS improved in a conversely proportional manner, especially for solid formulations.

TABLE 1

Smudge & MOFISS for Commercial Liquid and Solid Lubes versus Isostearic Acid

| Lubricant Product: | Solid/Liquid State | Rel. Smudge Ranking | Rel. MOFISS Ranking |
|---|---|---|---|
| Commercial Control (35% stearic acid; 40% ester) | solid | 6 | 1 |
| Modified Commercial Control (35% myristic acid; 40% ester) | solid | 7 | 2 |
| Comm. Myvacet 5-07 (ester) | creamy solid | 3 (tie) | 3 |
| Comm. Myvacet 7-07 (ester) | creamy solid | 2 | 4 |
| Comm. Myvacet 9-45 (ester) | liquid | 3 (tie) | 5 |
| Comm. Myvacet 9-08 (ester) | liquid | 1 | 7 |
| Isostearic Acid | liquid | 5 | 6 |

However, no materials showed excellent results in both test categories.

From a second set of data, different fatty acids were combined with propylene glycol dioleate ("PGD") or palm kernel oil ("PKO") which is greasy (and NOT liquidous) at room temperature. All of the lubricant blends from this study contained about 65 wt. % PGD or PKO with 35 wt. % fatty acid, the latter level being chosen to match that of the first commercial product identified above (in the first set of comparatives). Table 2A summarizes the relative smudge and MOFISS rankings for PGD lubricants; and Table 2B, those for PKO-based lubricant compositions.

TABLE 2A

Smudge and MOFISS for PGD-based Lubes

| PGD Plus: | Solid/Liquid State | Rel. Smudge Ranking | Rel. MOFISS Ranking |
|---|---|---|---|
| Stearic acid | solid | 5 | 1 |
| Myristic acid | solid | 3 | 2 |
| Oleic acid (Pamolyn 125) | liquid | 1 | 5 |
| Isostearic acid | liquid | 4 | 4 |
| Isostearic: Myristic (1:1) | greasy | 2 | 3 |

TABLE 2B

Smudge and MOFISS for PKO-based Lubes

| PKO Plus: | Solid/Liquid State | Rel. Smudge Ranking | Rel. MOFISS Ranking |
|---|---|---|---|
| Stearic acid | solid | 5 | 1 |
| Myristic acid | solid | 3 | 2 |
| Oleic acid (Pamolyn 125) | liquid | 1 | 5 |
| Isostearic acid | liquid | 2 | 4 |
| Isostearic: Myristic (1:1) | greasy | 4 | 3 |

Smudge results were unexpectedly improved with blends of oleic acid, however, MOFISS results were weaker. Solid fatty acids appeared to be best for friction and wear (MOFISS). For liquid blends, isostearic acid outperformed oleic acid.

In a third set of comparative data points, oleic acid was combined with various esters and with PAO 10 to identify a lubricant which provided a good COMBINATION of both smudge control and friction and wear characteristics. These results are summarized in following Table 3.

TABLE 3

Smudge and MOFISS for Oleic and Ester-based Lubes

| Lubricant Product: | Rel. Smudge Ranking | Rel. MOFISS Ranking |
|---|---|---|
| Commercial Control (35% stearic acid; 40% ester) | 6 | 2 |
| Oleic acid (Pamolyn 100) | 2 | 5 |
| PKO/Pamolyn 100 (65:35) | 5 | 1 |
| Comm. Myvacet 9-08 (ester)/ Pamolyn 100 (65:35) | 1 | 6 |
| Polyalphaolefin ("PAO") 10/ Pamolyn 100 (65:35) | 3 | 3 |
| Glycerol Monooleate/ Pamolyn 100 (65:35) | 4 | 4 |

Such data showed the difficulty of obtaining good results in both smudge and MOFISS testing. In the smudge rankings, liquid oleic acid and its blends outperformed the solid commercial control. In MOFISS tests, the combination of oleic with PKO was good, as was the commercial control (solid). The blend of oleic acid with PAO 10 showed some promise. From Table 3, a PAO IO/Oleic lubricant formulation gave the best combination of smudge control along with friction and wear performance. The straight oleic acid and blends with other esters were less effective, however.

From Tables 2A and 2B, isostearic acid blends were shown to outperform oleic acid blends in MOFISS testing. In the following set of comparative data, two levels of acids were tested.

TABLE 4

Smudge and MOFISS for Lube Combinations with and without Oleic Acid

| Lubricant Product: | Rel. Smudge Ranking | Rel. MOFISS Ranking |
|---|---|---|
| PAO 10/Isostearic (65:35) | 2 | 2 |
| PAO 10/Oleic/Isostearic (40:35:25) | 1 | 1 |

These results showed that smudge was improved with oleic acid present. MOFISS results showed an advantage for a lubricant that combined oleic acid with isostearic acid.

Table 5 showed the effect of the presence of isostearic acid in a PAO 10/Oleic acid blend.

TABLE 5

Effect of Isostearic Acid on Smudge

| Lubricant Product | Rel. Smudge Ranking |
|---|---|
| PAO 10/Oleic (90:10) | 1 |
| PAO 10/Oleic/Isostearic (40:35:25) | 2 |

The foregoing data indicated that the addition of isostearic acid to improve friction and wear characteristics compromised smudge abatement to some extent. In effect, the lubricant formulation can be tailored (or customized) for optimum metal working (elevated isostearic acid levels) OR for smudge control (no or low isostearic acid). Where odor control is important, a portion of the oleic acid can be substituted with isostearic acid, especially a product with low iodine value.

Smudge testing showed no significant effect for the addition of up to 4% lecithin to a preferred lubricant composition. Further testing showed that additions of *about 0.25 wt. % BHT (antioxidant) to the preferred PAO IO/Oleic/Isostearic (40:35:25) blend minimized off-odor generation by lubricated sheet for at least 18 days in odor panel tests. Additions of 1.0 wt. % BHT minimized off-odor generation for at least 60 days. These tests were performed under accelerated aging conditions of 100° F. in an oven at 50% relative humidity for simulating summer warehousing conditions.

Having described the presently preferred embodiments, it is to be understood that the invention may be otherwise embodied by the scope of the claims appended hereto.

What is claimed is:

1. A metal sheet product having a first and second surface at least one of which is lubricated with an ester-free, fatty alcohol-free composition that is suitable for direct food contact and consists essentially of:

(a) about 10–90 wt. % of a polyalphaolefin;

(b) about 10–90 wt. % of an oleic acid; and (c) about 0–60 wt. % of an isostearic acid.

2. The sheet product of claim 1 wherein the metal is an aluminum alloy.

3. The sheet product of claim 2 wherein said alloy is at least 95% pure aluminum.

4. The sheet product of claim 2 wherein said alloy is selected from the group consisting of: 1050, 1100, 1145, 3003, 3004, 5017, 5042, 5052, 5082, 5182, 5352, 8011 and 8111 aluminum (Aluminum Association designations).

5. The sheet product of claim 1 which is used to make formed food containers.

6. The sheet product of claim 1 which is used to make an industrial sheet product selected from the group consisting of fin stock, non-food lidding and air handling equipment.

7. The sheet product of claim 1 wherein said composition contains about 15–65 wt. % of said polyalphaolefin.

8. The sheet product of claim 1 wherein said composition contains about 20–60 wt. % of said oleic acid.

9. The sheet product of claim 1 wherein said composition contains about 10–40 wt. % of said isostearic acid.

10. The sheet product of claim 1 wherein said composition contains about 25–50 wt. % of said polyalphaolefin; about 25–50 wt. % of said oleic acid; and about 10–35 wt. % of said isostearic acid.

11. The sheet product of claim 1 wherein said composition further contains up to about 10 wt. % of a conductivity enhancer.

12. The sheet product of claim 11 wherein said conductivity enhancer consists essentially of lecithin.

13. The sheet product of claim 1 wherein said composition further contains up to about 5 wt. % of an antioxidant.

14. The sheet product of claim 13 wherein said antioxidant is selected from the group consisting of: butylated hydroxytoluene; butylated hydroxyanisole; a tocopherol; and mixtures thereof.

15. The sheet product of claim 13 wherein said antioxidant consists essentially of butylated hydroxytoluene.

16. The sheet product of claim 1 wherein said composition contains about 25–50 wt. % of said polyalphaolefin; about 25–50 wt. % of said oleic acid; up to about 35 wt. % of said isostearic acid and about 2–7 wt. % lecithin.

17. The sheet product of claim 16 wherein said composition further contains about 0.02–5 wt. % butylated hydroxytoluene.

18. The sheet product of claim 1 wherein said composition contains about 25–50 wt. % of said polyalphaolefin; about 25–50 wt. % of said oleic acid; about 10–35 wt. % of said isostearic acid and about 0.02–5 wt. % butylated hydroxytoluene.

19. The sheet product of claim 18 wherein said composition contains about 30–50 wt. % of said polyalphaolefin; about 30–40 wt. % of said oleic acid; about 15–30 wt. % of said isostearic acid; about 0.1–3 wt. % butylated hydroxytoluene; and about 2–7 wt. % lecithin.

20. Formed food container stock made from an aluminum alloy having a first and second surface, at least one surface of which has been treated with an ester-free, fatty alcohol-free lubricant composition that is suitable for direct food contact and consists essentially of:

(a) about 10–90 wt. % of a polyalphaolefin;

(b) about 10–90 wt. % of an oleic acid;

(c) up to about 60 wt. % of an isostearic acid; and (d) about 0.02–5 wt. % of an antioxidant.

21. The container stock of claim 20 wherein said alloy is selected from the group consisting of: 1050, 1100, 1145, 3003, 3004, 5017, 5042, 5052, 5082, 5182, 5352, 8011 and 8111 aluminum (Aluminum Association designations).

22. The container stock of claim 20 onto at least one surface of which about 0.1–30 mg/ft$^2$ of said composition has been deposited.

23. The container stock of claim 20 wherein said composition contains about 15–65 wt. % of said polyalphaolefin.

24. The container stock of claim 20 wherein said composition contains about 20–60 wt. % of said oleic acid.

25. The container stock of claim 20 wherein said composition contains about 10–40 wt. % of said isostearic acid.

26. The container stock of claim 20 wherein said composition contains about 25–50 wt. % of said polyalphaolefin; about 25–50 wt. % of said oleic acid; about 0–35 wt. % of said isostearic acid; and about 0.1–3 wt. % of said antioxidant.

27. The container stock of claim 20 wherein said composition further contains up to about 10 wt. % of a conductivity enhancer.

28. The container stock of claim 27 wherein said conductivity enhancer consists essentially of lecithin.

29. The container stock of claim 20 wherein said composition further contains about 2–7 wt. % lecithin.

30. The container stock of claim 20 wherein said antioxidant is selected from the group consisting of: butylated hydroxytoluene; butylated hydroxyanisole; a tocopherol; and mixtures thereof.

31. The container stock of claim 30 wherein said antioxidant consists essentially of butylated hydroxytoluene.

32. Industrial sheet product made from an aluminum alloy having a first and second surface, at least one surface of which has been treated with an ester-free, fatty alcohol-free lubricant composition consisting essentially of:

(a) about 10–90 wt. % of a polyalphaolefin;

(b) about 10–90 wt. % of an oleic acid; and (c) about 0–60 wt. % of an isostearic acid.

33. The industrial sheet product of claim 32 wherein said alloy is selected from the group consisting of: 1050, 1100, 1145, 3003, 3004,5017, 5042, 5052, 5082, 5182, 5352, 8011 and 8111 aluminum (Aluminum Association designations).

34. The industrial sheet product of claim 32 onto at least one surface of which about 0.1–30 mg/ft$^2$ of said composition has been deposited.

35. The industrial sheet product of claim 32 wherein said composition contains about 15–65 wt. % of said polyalphaolefin.

36. The industrial sheet product of claim 32 wherein said composition contains about 20–60 wt. % of said oleic acid.

37. The industrial sheet product of claim 32 wherein said composition contains about 10–40 wt. % of said isostearic acid.

38. The industrial sheet product of claim 32 wherein said composition contains about 25–50 wt. % of said polyalphaolefin; about 25–50 wt. % of said oleic acid; and about 10–35 wt. % of said isostearic acid.

39. The industrial sheet product of claim 32 wherein said composition further contains up to about 10 wt. % of a conductivity enhancer.

40. The industrial sheet product of claim 39 wherein said conductivity enhancer consists essentially of lecithin.

41. The industrial sheet product of claim 32 wherein said composition further contains about 2–7 wt. % lecithin.

42. The industrial sheet product of claim 32 wherein said composition further contains up to about 5 wt. % of an antioxidant.

43. The industrial sheet product of claim 42 wherein said antioxidant is selected from the group consisting of: butylated hydroxytoluene; butylated hydroxyanisole; a tocopherol; and mixtures thereof.

44. The industrial sheet product of claim 42 wherein said antioxidant consists essentially of butylated hydroxytoluene.

45. The industrial sheet product of claim 32 wherein said composition contains about 25–50 wt. % of said polyalphaolefin; about 25–50 wt. % of said oleic acid; about 10–35 wt. % of said isostearic acid and about 2–7 wt. % lecithin.

46. The industrial sheet product of claim 45 wherein said composition further contains about 0.02–5 wt. % butylated hydroxytoluene.

47. The industrial sheet product of claim 32 wherein said product is selected from the group consisting of fin stock, non-food lidding and air handling equipment.

48. An ester-free, fatty alcohol-free lubricant composition that is suitable for direct food contact, said composition consisting essentially of:

(a) about 10–90 wt. % of a polyalphaolefin;

(b) about 10–90 wt. % of an oleic acid; and (c) about 0–60 wt. % of an isostearic acid.

49. The lubricant composition of claim 48 which is suitable for use with container and tray stock made from an aluminum alloy selected from the group consisting of: 1050, 1100, 1145, 3003, 3004, 5017, 5042, 5052, 5082, 5182, 5352, 8011 and 8111 aluminum (Aluminum Association designations).

50. The lubricant composition of claim 48 which contains about 15–65 wt. % of said polyalphaolefin.

51. The lubricant composition of claim 48 which contains about 20–60 wt. % of said oleic acid.

52. The lubricant composition of claim 48 which contains about 10–40 wt. % of said isostearic acid.

53. The lubricant composition of claim 48 which contains about 25–50 wt. % of said polyalphaolefin; about 25–50 wt. % of said oleic acid; and about 0–35 wt. % of said isostearic acid.

54. The lubricant composition of claim 48 which further contains up to about 10 wt. % of a conductivity enhancer.

55. The lubricant composition of claim 54 wherein said conductivity enhancer consists essentially of lecithin.

56. The lubricant composition of claim 48 which further contains up to about 5 wt. % of an antioxidant.

57. The lubricant composition of claim 56 wherein said antioxidant is selected from the group consisting of: butylated hydroxytoluene; butylated hydroxyanisole; a tocopherol; and mixtures thereof.

58. The lubricant composition of claim 56 wherein said antioxidant consists essentially of butylated hydroxytoluene.

59. The lubricant composition of claim 48 which contains about 25–50 wt. % of said polyalphaolefin; about 25–50 wt. % of said oleic acid; about 0–35 wt. % of said isostearic acid and about 0.1–3 wt. % butylated hydroxytoluene.

60. The lubricant composition of claim 59 which further contains about 2–7 wt. % lecithin.

* * * * *